US006024066A

United States Patent [19]

Nakayama et al.

[11] Patent Number: 6,024,066

[45] Date of Patent: Feb. 15, 2000

[54] AIR-INTAKE MODULE FOR INTERNAL COMBUSTION ENGINE

[75] Inventors: Toshiaki Nakayama, Nishikamo-gun; Hideki Inaba, Gifu, both of Japan

[73] Assignees: Denso Corporation; Toyoda Boshoku Corporation, both of Japan

[21] Appl. No.: 09/131,396

[22] Filed: Aug. 7, 1998

[30] Foreign Application Priority Data

Oct. 30, 1997 [JP] Japan ..... 9-298721

[51] Int. Cl.[7] ..... F02M 35/10

[52] U.S. Cl. ..... 123/184.21; 123/184.24; 123/184.42; 123/184.47; 123/198 E

[58] Field of Search ..... 123/184.21, 198 E, 123/184.24, 184.34, 184.42, 184.47

[56] References Cited

U.S. PATENT DOCUMENTS

| | | | |
|---|---|---|---|
| 4,183,332 | 1/1980 | Hotbaüer et al. | 123/184.42 |
| 4,301,775 | 11/1981 | Smart et al. | 123/184.61 |
| 5,176,114 | 1/1993 | Brackett | 123/184.42 |
| 5,259,356 | 11/1993 | Karlsson et al. | 123/541 |
| 5,575,247 | 11/1996 | Nakayama et al. | 123/184.21 |
| 5,630,387 | 5/1997 | Kamiyama | 123/184.38 |
| 5,664,533 | 9/1997 | Nakayama et al. | 123/184.42 |
| 5,713,323 | 2/1998 | Walsh et al. | 123/184.42 |
| 5,769,045 | 6/1998 | Edwards et al. | 123/184.61 |
| 5,816,213 | 10/1998 | Gaviani et al. | 123/198 E |
| 5,826,553 | 10/1998 | Nakayama et al. | 123/184.42 |

FOREIGN PATENT DOCUMENTS

| | | |
|---|---|---|
| 0 523 027 A2 | 1/1993 | European Pat. Off. . |
| 6-81735 | 3/1994 | Japan . |
| 8-93580 | 4/1996 | Japan . |

*Primary Examiner*—Noah P. Kamen
*Assistant Examiner*—Hai Huynh
*Attorney, Agent, or Firm*—Nixon & Vanderhye PC

[57] ABSTRACT

All the components constituting an air-intake module for an internal combustion engine, including an air cleaner for cleaning air and manifold pipes for distributing air into each cylinder of the engine, are integrated in a single unit. A mounting flange connected to engine side ends of the manifold pipes is fixed to the engine for mounting the air-intake module as a whole. The air cleaner and other components of the module are located under the mounting flange and the manifold pipes, so that the mounting of the module is not obstructed by components constituting the module. An air cleaner element for filtering the intake air is slidably inserted into the air cleaner at a position where the element can be easily serviced from the outside of the module without dismounting any components of the module.

18 Claims, 7 Drawing Sheets

AIR-INTAKE MODULE FOR INTERNAL COMBUSTION ENGINE

CROSS-REFERENCE TO RELATED APPLICATION

This application is based upon and claims benefit of priority of Japanese Patent Application No. Hei-9-298721 filed on Oct. 30, 1997, the content of which is incorporated herein by reference.

BACKGROUND OF THE INVENTION

1. Field of the Invention

The present invention relates to an air-intake module for an internal combustion engine, in which an air cleaner, a throttle body, a surge tank, intake manifold pipes and other components are integrated into a single module that can be mounted on the engine as a single unit.

2. Description of Related Art

An air-intake device for an internal combustion engine includes an air cleaner, a throttle body, a surge tank, an intake manifold and other components. A throttle valve installed in the throttle body is operated by an acceleration pedal, so that an amount of intake air is controlled. The intake air is mixed with fuel and supplied to the engine. An air-intake module into which all components are integrated is disclosed, for example, in JP-A-6-81735 and EP-0523027-A2. It is possible to reduce the number of parts and to simplify an assembling process by integrating components in a single module.

In the conventional integrated modules, one end of a manifold is mounted on and fixed to the engine, and an air cleaner is disposed above the manifold. Therefore, a working space for mounting the module on the engine is covered by the air cleaner, and, accordingly, it is hard to mount the module on the engine. For example, in the air-intake module disclosed in JP-A-6-81735, an upper portion of a manifold is covered by an air cleaner case. The air cleaner case has to be disassembled from the module when the module is mounted on an engine. Otherwise, there is no working space for mounting. In the air-intake module disclosed in EP-0523027-A2, a whole rear portion of a mounting flange disposed at one end of a manifold is covered by an filter housing. Therefore, an air cleaner element disposed in the housing and its upper cover have to be removed from the module to mount the module on an engine.

SUMMARY OF THE INVENTION

The present invention has been made in view of the above-mentioned problem, and an object of the present invention is to provide an air-intake module for an internal combustion engine, which can be easily mounted on an engine without removing components or parts from the module. Another object of the present invention is to provide an air-intake module in which an air cleaner element can be easily installed in and removed from the module for maintenance service.

An air cleaner containing an air cleaner element therein and manifold pipes for supplying air to the engine are connected through connecting members, thereby forming a single module. The connecting members include a connecting duct, a surge tank and a throttle body. One end of each manifold pipe is connected to the surge tank, and the other end of each manifold pipe is connected to a mounting flange. The mounting flange and the manifold pipes are positioned above the air cleaner so that the manifold pipes embrace the air cleaner thereunder. The mounting flange is fixed to the engine by bolts and screws, thereby mounting the module on the engine as a whole. A working space for tightening screws are provided in the module, and the working line extends perpendicularly to the surface of the mounting flange above the air cleaner so that the air cleaner or other components of the module do not interfere with the working line. Therefore, the module can be easily mounted on the engine without disassembling any components from the module. Preferably, the throttle body is connected to a substantial center of the surge tank, and the manifold pipes are formed in an equal length, so that air distribution to each engine cylinder becomes uniform.

The air cleaner element may be slidably and vertically inserted into the air cleaner at a position where the air cleaner is not covered by the manifold pipes. Alternatively, the air cleaner element may be slidably and horizontally inserted into the air cleaner at an upper portion of the air cleaner. In both cases, the air cleaner element can be easily serviced without being obstructed by other components of the module. It is also possible to form the air cleaner element in a cylindrical shape which extends horizontally to the inner space of the air cleaner or extends outward form the air cleaner. Preferably, the cylindrical surface of the air cleaner element is serpentined so that it expands or contracts in its axial direction.

Other objects and features of the present invention will become more readily apparent from a better understanding of the preferred embodiments described below with reference to the following drawings.

DETAILED DESCRIPTION OF THE PREFERRED EMBODIMENTS

A first embodiment of the present invention will be described, referring to FIGS. 1–6. The most important feature of the present invention resides in that an air cleaner is placed under a mounting flange of an air-intake module to secure a working space for mounting the module on an engine.

Figure 1:
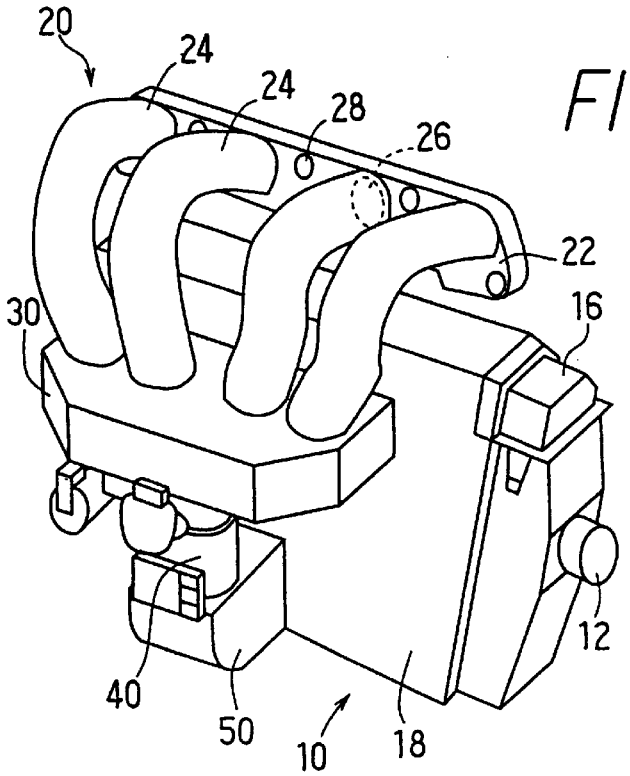
FIG. 1 is a perspective view showing an air-intake module as a first embodiment of the present invention.
Figure 2:
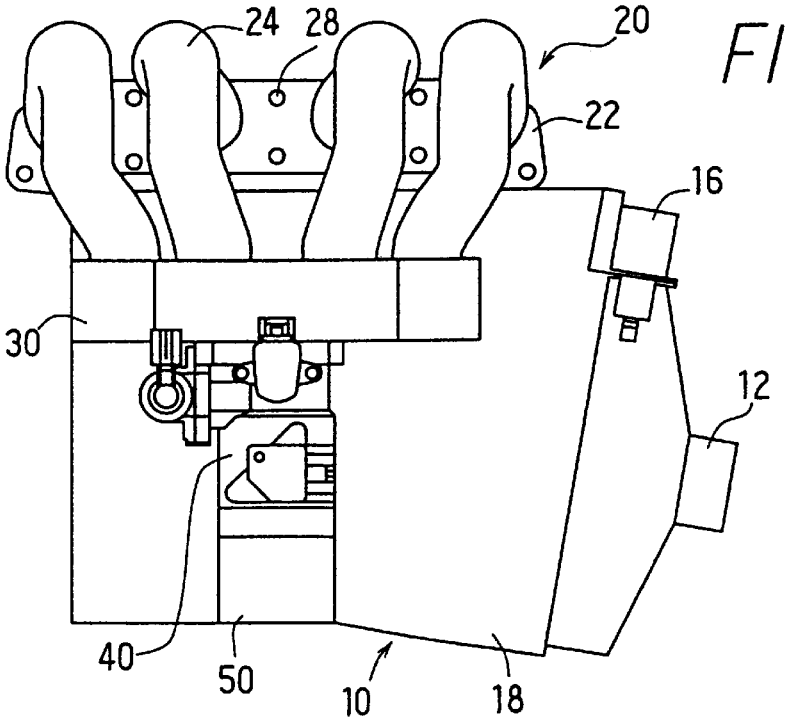
FIG. 2 is a front view showing the air-intake module shown in FIG. 1.
Figure 3:
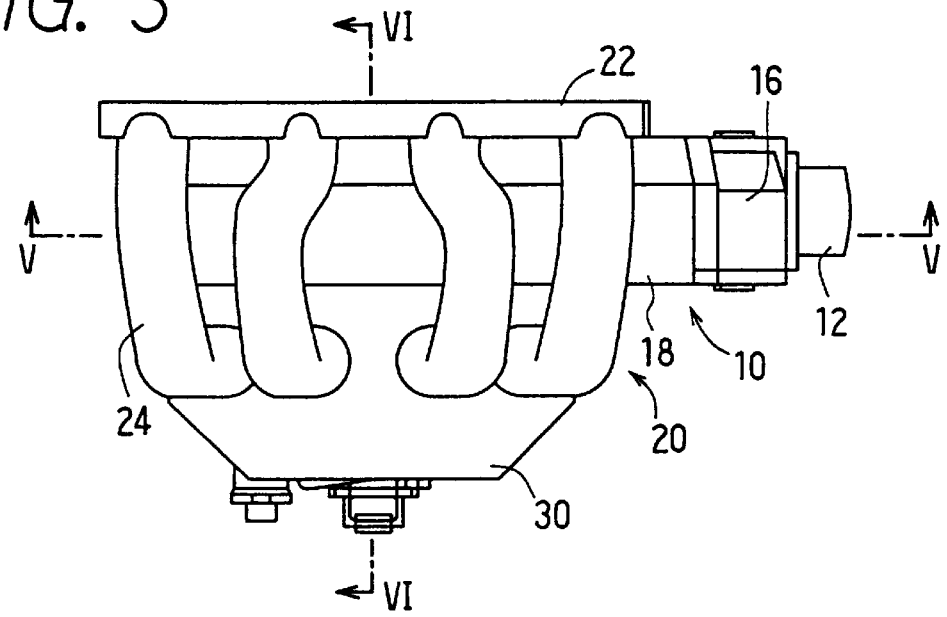
FIG. 3 is a top view showing the air-intake module shown in FIG. 1.
Figure 4:
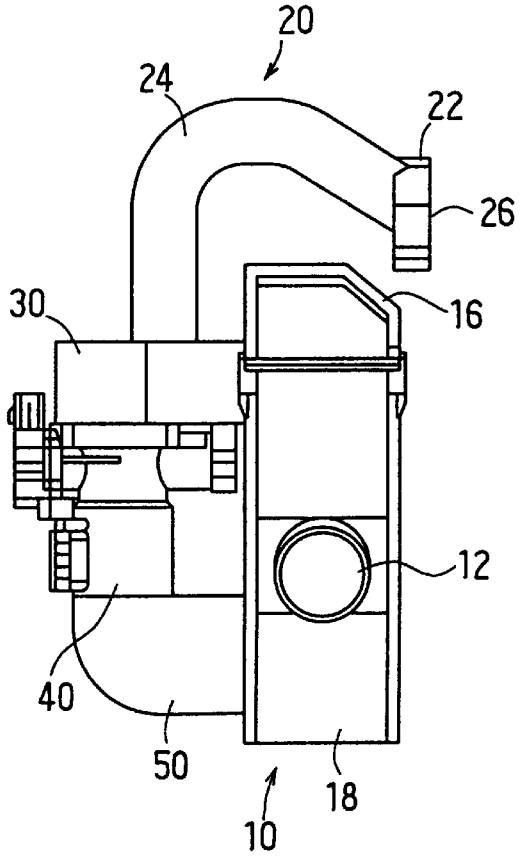
FIG. 4 is a right side view showing the air-intake module shown in FIG. 1.
Figure 5:
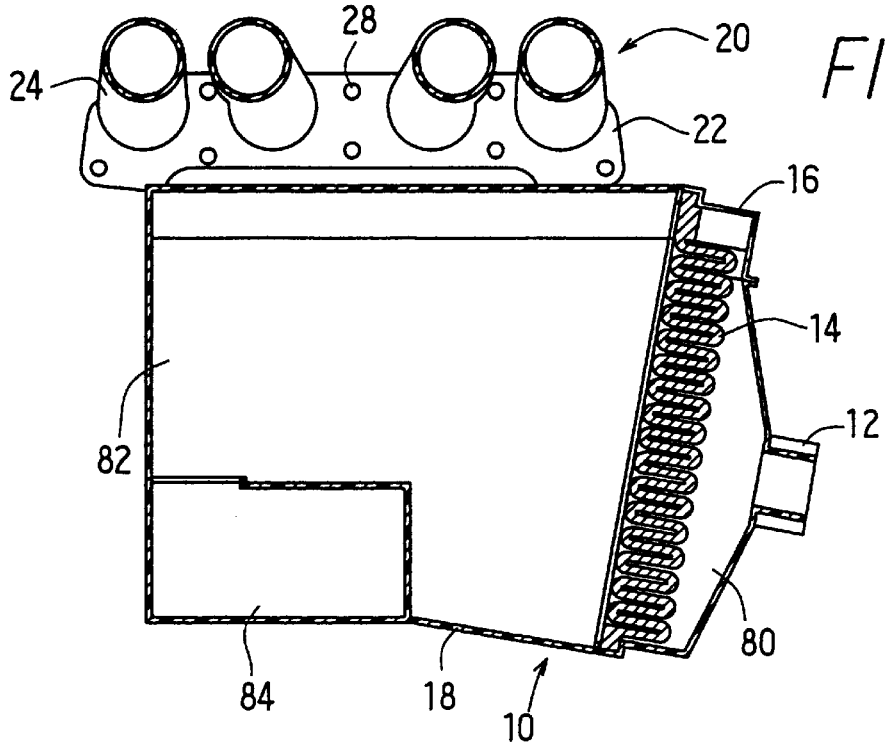
FIG. 5 is a cross-sectional view showing the air-intake module shown in FIG. 1, taken along a line V—V of FIG. 3.
Figure 6:
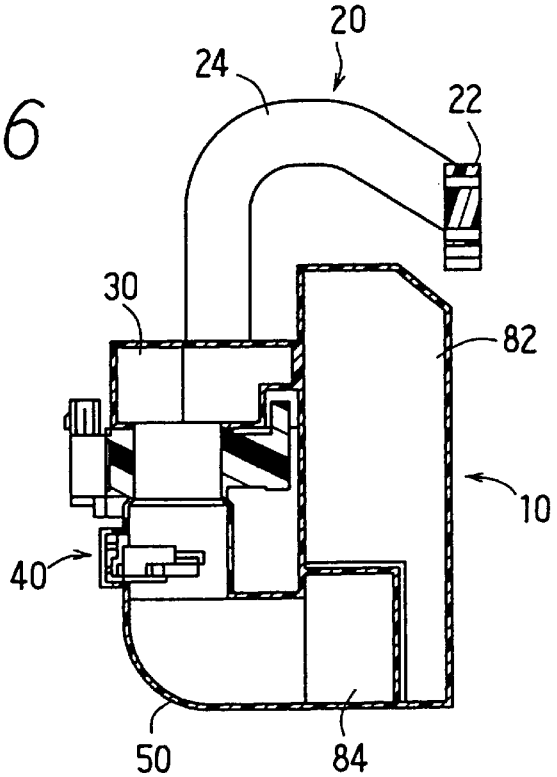
FIG. 6 is a cross-sectional view showing the air-intake module shown in FIG. 1, taken along a line VI—VI of FIG. 3.

FIG. 1 shows the air-intake module as the first embodiment of the present invention, FIG. 2 a front view, FIG. 3 a top view, FIG. 4 a right side view, and FIGS. 5, 6 cross-sectional views, all showing the first embodiment. Following description will be made referring to all of those drawings. The air-intake module includes an air cleaner 10 which cleans air taken into the module from an air-intake port 12, an intake manifold 20 having four manifold pipes 24 and a mounting flange 22 fixed to one end of the manifold pipes 24, a surge tank 30 connected to the other end of the manifold pipes 24, a throttle body 40 connected to a substantial center of the surge tank 30, and a duct 50 which connects the throttle body 40 and the air cleaner 10. All of those components are integrated into a single module which is mounted on an engine as a whole.

The air cleaner 10 (as best seen in FIG. 5) is composed of an air cleaner case 18, an air cleaner element 14 disposed in the air cleaner case 18, and a cap 16 disposed on an upper end portion of the air cleaner case 18. The air cleaner element 14 divides an inside space of the air cleaner case 18 into two spaces, a dusty-side space 80 and a clean-side space 82. The air cleaner element 14 is made of non-woven cloth, filtering paper or the like. A cross-sectional area of the air cleaner case 18 is substantially rectangular and is divided into two spaces by the air cleaner element 14 disposed substantially vertically at a position near one end of the air cleaner case 18. Air introduced into the dusty-side space 80 through the air-intake port 12 is filtered and cleaned by the air cleaner element 14, and then introduced into the clean-side space 82. The air cleaner element 14 can be installed or removed for maintenance services by slidably moving it in a direction perpendicular to the air flow direction. When the air cleaner element 14 is installed in the air cleaner case 18, it is air-tightly held in position by a seal member (not shown) formed around its periphery. The cap 16 closes an opening for installing and removing the air cleaner element 14 and also serves as a grip for taking out and inserting the air cleaner element 14.

A space 84 is formed at a part of a bottom portion of the air cleaner case 18. The space 84 is connected to the connecting duct 50. The air in the clean-side space 82 is introduced into the space 84 and then enters into the connecting duct 50. The connecting duct 50 connects the space 84 and the throttle body 40, and introduces the cleaned air into the throttle body 40. A throttle valve (not shown) which is operated to control an amount of air to be introduced into the engine by an acceleration pedal is disposed in the throttle body 40. The surge tank 30 is box-shaped (as best seen in FIG. 1), and air is introduced therein from the throttle body 40. Pressure pulsation of the air introduced into the surge tank 40 is alleviated therein. The manifold 20 having the manifold pipes 24 (the number of the manifold pipes corresponds to the number of cylinders of the engine) is connected to the surge tank 30 at a top surface thereof. Air in the surge tank 30 is sucked into the manifold pipes 24 and then into the engine cylinders through manifold holes 26 formed at each end of the manifold pipes 24. Because the throttle body 40 is connected to the center portion of the surge tank 30, harmful noises caused by sucking air are suppressed, and air is distributed equally to each manifold pipes 24.

The mounting flange 22 for mounting the integrated module on the engine is formed at the engine side end of the intake-manifold 20. Each manifold pipe 24 is connected to the mounting flange 22. Plural mounting holes 28 are formed on the mounting flange 22. Bolts (not shown) are inserted into the mounting holes 28, and a whole module is fixed to the engine by screwing nuts (not shown) onto the bolts. Each manifold pipe 24 extends from the surge tank 30 toward the engine so that it covers the upper side of the air cleaner 10. The manifold ports 26 of the manifold pipes 24 are located above the air cleaner 10. The bolts for mounting the module on the engine extend perpendicularly to the surface of the mounting flange 22 through the mounting holes 28. In other words, the longitudinal direction of the mounting bolts (a working line for mounting the module on the engine) is perpendicular to the surface of the mounting flange 22 and extends above the air cleaner 10, so that the air cleaner 10 does not interfere with a working space for mounting the module on the engine.

Now, the function of the first embodiment will be described. Air introduced into the dusty-side space 80 through the air-intake port 12 is cleaned by the filter element 14 and then enters into the clean-side space 82. The cleaned air flows into the surge tank 30 through the space 84, the connecting duct 50 and the throttle body 40. The air in the surge tank 30 is distributed to four manifold pipes 24 and is sucked into the engine cylinders through the manifold ports 26. The amount of air supplied to the engine cylinders is controlled by the throttle valve installed in the throttle body 40. A fuel injector (not shown) is installed for each engine cylinder, and fuel injected from the fuel injector is mixed with air supplied from the air-intake module.

As described above, since the working line for mounting the module on the engine extends above the air cleaner 10 so that the air cleaner 10 does not interfere with working line, the air-intake module can be easily mounted on the engine as a whole without disassembling any components from the module. In addition, the manifold pipes 24 can be arranged freely because no other parts interfere with the space for the manifold pipes 24. Accordingly, it is possible to design the length of each manifold pipe 24 to be equal. It is also possible to connect the throttle body 40 to the surge tank 30 at a substantial center of the surge tank 30. Because of the structure of the first embodiment above described, harmful noises of air-intake are alleviated, and intake-air is equally distributed to each engine cylinder.

The air cleaner element 14 is placed in a side portion of the air cleaner case 18 which is not covered by the manifold pipes 24, though most part of the air cleaner case 18 is covered by the manifold pipes 24 (as better seen in FIGS. 1 and 5). The air cleaner element 14 can be inserted into and removed from the air cleaner case 18 in the vertical direction without being obstructed by other components. Therefore, the maintenance service for the air cleaner element 14 is easily performed.

Figure 7:
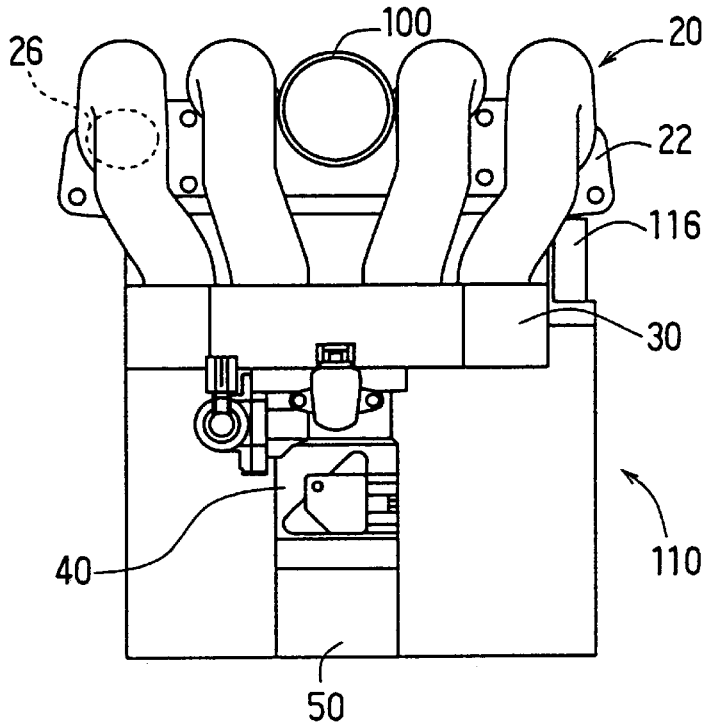
FIG. 7 is a front view showing an air-intake module as a second embodiment of the present invention.
Figure 8:
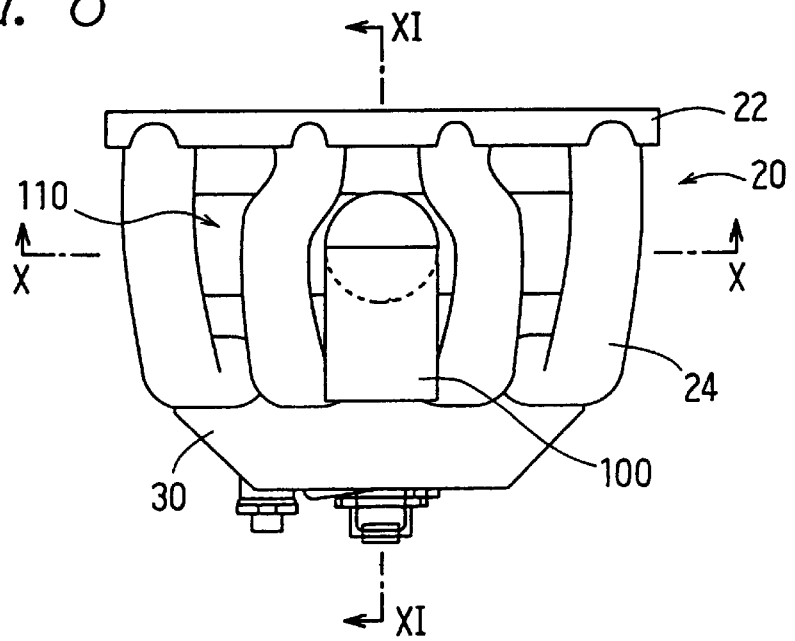
FIG. 8 is a top view showing the air-intake module shown in FIG. 7.
Figure 9:
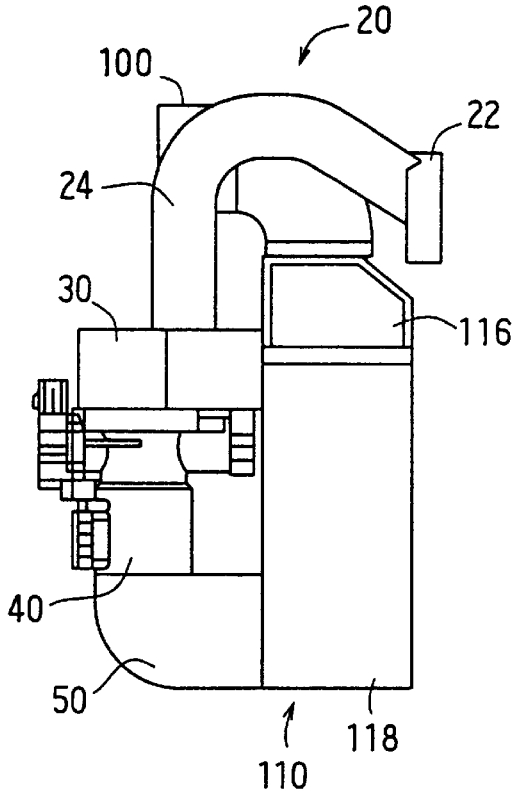
FIG. 9 is a right side view showing the air-intake module shown in FIG. 7.

A second embodiment of the present invention will be described, referring to FIGS. 7–11. FIG. 7 is a front view of the air-intake module as the second embodiment, FIG. 8 a top view, FIG. 9 a right side view, FIG. 10 a cross-sectional view (taken along a line X—X of FIG. 8), and FIG. 11 a cross-sectional view (taken along a line XI—XI of FIG. 8). In the second embodiment, the air cleaner element 114 is placed at an upper portion of the air cleaner case 118. Other structures of the second embodiment are similar to those of the first embodiment. The air-intake module includes an air cleaner 110 which cleans air sucked from an air-intake port 112 formed at an end of a duct 100, a manifold 20 having manifold pipes 24 and a mounting flange 22 formed at an engine side end of the manifold 20, a surge tank 30 connected to the other end of the manifold 20, a throttle body 40 connected to a center portion of the surge tank 30, and a connecting duct 50 which connects the throttle body 40 and the air cleaner 110.

Figure 10:
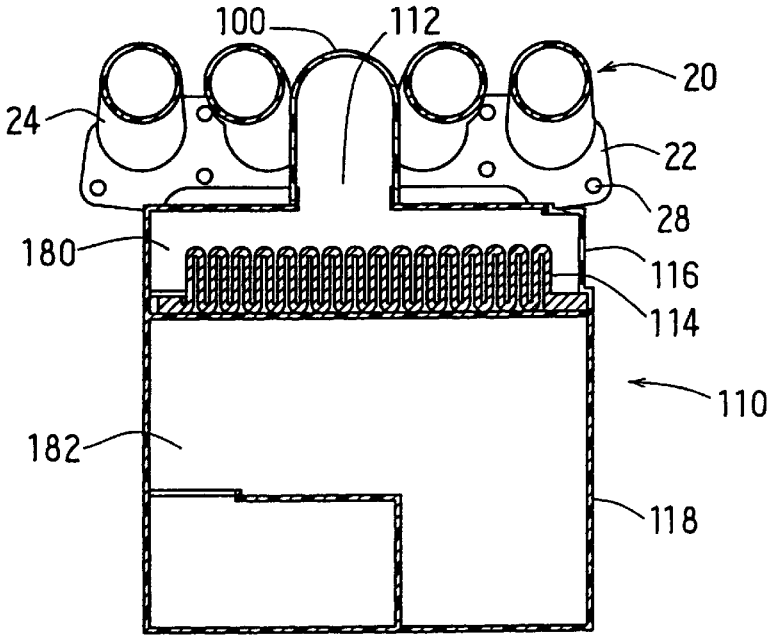
FIG. 10 is a cross-sectional view showing the air-intake module shown in FIG. 7, taken along a line X—X of FIG. 8.
Figure 11:
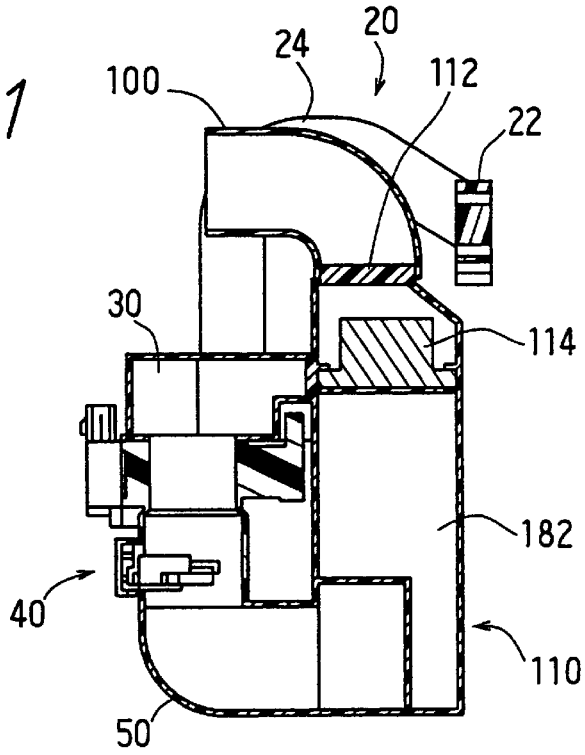
FIG. 11 is a cross-sectional view showing the air-intake module shown in FIG. 7, taken along a line XI—XI of FIG. 8.

As better seen in FIG. 10, the air cleaner 110 is composed of an air cleaner case 118, an air cleaner element 114 disposed in an upper portion of the air cleaner case 118, and a cap 116 disposed at a right side end of the air cleaner case 118. A space in the air cleaner case 118 is divided into two spaces by an air cleaner element 114, a dusty-side space 180 into which outside air is introduced and a clean-side space 182 into which air cleaned by the air filter element 114 is introduced. The air cleaner element 114 is inserted into and removed from the air cleaner case 118 by slidably moving it in a horizontal direction. When the air cleaner element 114 is installed in the air cleaner case 118, it is air-tightly held in the air cleaner case 118 by a seal formed around a periphery of the air cleaner element 114. Since other structures are similar to those of the first embodiment, detailed description thereof is not repeated here.

The mounting flange 22 is located above the air cleaner 110 and other components, and the working line for mounting the air-intake module on the engine extends above the air cleaner 110. Accordingly, the air-intake module can be easily mounted on the engine in the same manner as in the first embodiment. The air cleaner element 114 is placed at the upper portion of the air cleaner case 118 and is slidably removable in the horizontal direction. Therefore, the maintenance service of the air cleaner element 114 can be easily performed without being obstructed by other components though the manifold pipes 24 cover a whole space above the cleaner 110.

Figure 12:
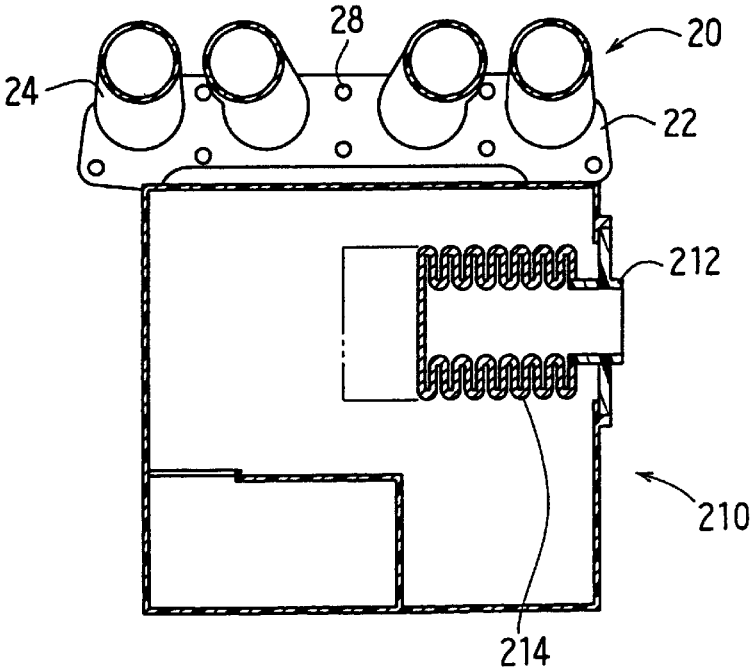
FIG. 12 is a cross-sectional view showing a modified form of the first and second embodiments, and shows a similar cross-section as in FIG. 5.
Figure 13:
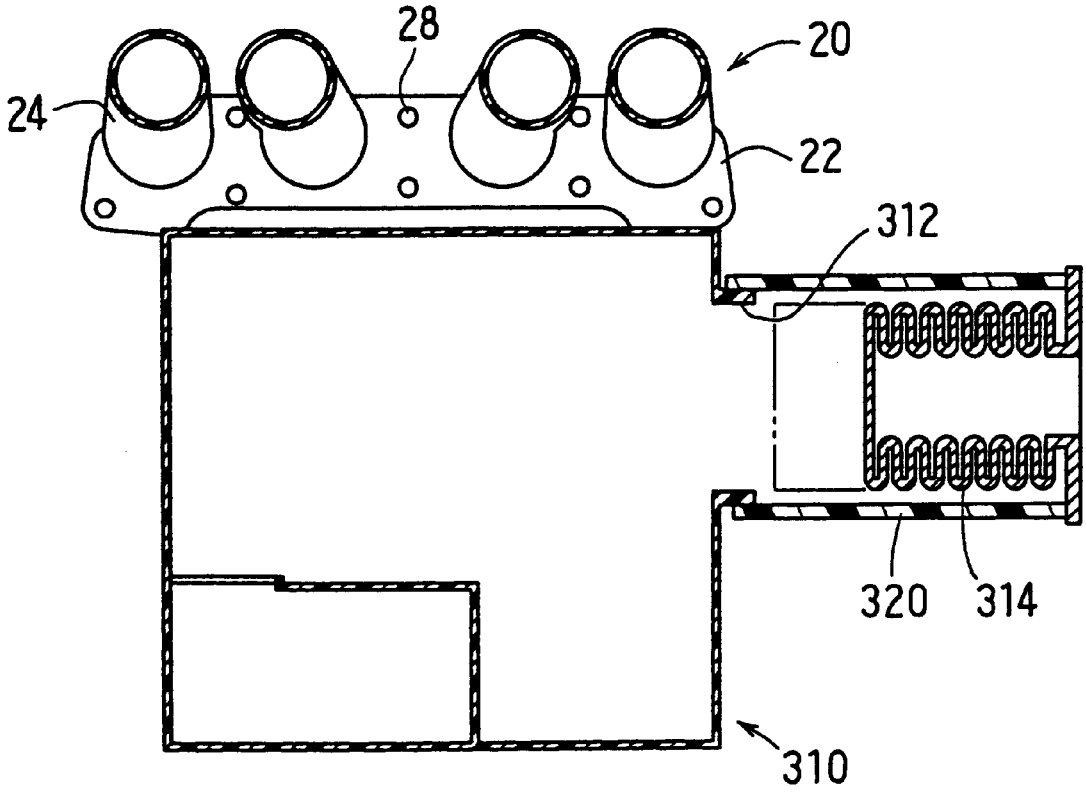
FIG. 13 is a cross-sectional view showing another modified form of the first and second embodiments, and shows a similar cross-section as in FIG. 5.

The present invention may be modified in various forms, for example, the air cleaner element may be installed in the air cleaner case as shown in FIG. 12 or FIG. 13. FIGS. 12 and 13 show cross-sections which are similar to those shown in FIGS. 5 and 10. An air cleaner 210 shown in FIG. 12 has an air cleaner element 214 which includes an air-intake port 212 integrally formed with the air cleaner element 214. The air cleaner element 214 is formed in a cylindrical shape which stretches or contracts in its axial direction. The air cleaner element 214 including the air-intake port 212 is installed horizontally in the air cleaner case from a right side wall of the air cleaner case. The air cleaner element 214 is easily installed by contracting its axial length which is in turn expanded by air pressure when the module is in use.

FIG. 13 shows another modification, in which a cylindrical duct 320 is horizontally fixed to an air-intake port 312, and an air cleaner element 314 is inserted in the cylindrical duct 320. The air cleaner element 314 has a similar shape as the air cleaner element 214, and its axial length is flexible so that it is contracted when installed and expanded when used. It is not essential, however, to form the air cleaner elements 214 and 314 to be flexible in the axial length. They may be made in a solid form having a fixed axial length.

Though the number of the manifold pipes is four in the embodiments above described, it is not limited to four, but it is varied according to the number of cylinders of the engine on which the air-intake module is mounted. It is not essential to make the length of each manifold pipe equal, but it may be modified to best fit the engine.

The present invention has been shown and described with reference to the foregoing preferred embodiments, it will be apparent to those skilled in the art that changes in form and detail may be made therein without departing from the scope of the invention as defined in the appended claims.

What is claimed is:

1. An air-intake module for an internal combustion engine comprising:

an air cleaner including an air cleaner case and an air cleaner element disposed in said air cleaner case for cleaning air flowing therethrough;

a plurality of intake manifold pipes, one end of each intake manifold pipe being connected to the air cleaner case through connecting members for receiving clean air therefrom; and a mounting flange having a mounting surface provided at the other end of each intake manifold pipe for mounting said intake manifold pipes to the engine, wherein:

the air cleaner case, the intake manifold pipes, said connecting members, and the mounting flange are all integrated into a single module, a working line for mounting said single module on the engine is defined in a direction substantially perpendicular to and intersecting said mounting surface of said mounting flange, at least a substantial portion of the air cleaner case is positioned in an area vertically below at least a portion of the manifold pipes so that the manifold pipes embrace the air cleaner case thereunder, the air cleaner element is disposed substantially immediately adjacent the manifold pipes, and the working line is defined above the air cleaner case, the air cleaner is disposed within a horizontal length of the manifold pipes, and said air cleaner element is mounted so as to be removable from said module by displacing said air cleaner element outwardly relative to a wall of said air cleaner case, said air cleaner case and said air cleaner element being positioned relative to said manifold pipes, said mounting flange and the engine such that when the mounting flange is mounted to the engine, said air cleaner element is removable in a manner free from interference from said manifold pipes and the engine.

2. The air-intake module for an internal combustion engine as in claim 1, wherein:

the air cleaner element is substantially vertically disposed in the air cleaner case at a side portion of the air cleaner case, the side portion being laterally offset from a vertical plane of the manifold pipes located above the air cleaner case.

3. The air-intake module for an internal combustion engine as in claim 2, wherein:

the air cleaner element is inserted into and removed from the air cleaner case by sliding the air cleaner element in a substantially vertical direction.

4. The air-intake module for an internal combustion engine as in claim 1, wherein:

the air cleaner element is substantially horizontally disposed in the air cleaner case at an upper portion of the air cleaner case; and the air cleaner element is inserted into and removed from the air cleaner case by sliding the air cleaner element in a substantially horizontal direction.

5. The air-intake module for an internal combustion engine as in claim 1, further comprising an air-intake port defining an air inlet to said air cleaner case, and wherein:

the air cleaner element is cylinder-shaped having a cylindrical side wall, an open end and a closed end wall; and the cylinder-shaped air cleaner element is attached to the air-intake port so that a longitudinal axis of the air cleaner element extends in a horizontal direction.

6. The air-intake module for an internal combustion engine as in claim 5, wherein: the cylindrical side wall of the air cleaner element is serpentined whereby the cylindrical side wall is expandable and contractible in an axial direction.

7. The air-intake module for an internal combustion engine as in claim 5, wherein:

the open end of the air cleaner element is attached to the air-intake port so that the cylindrical side wall of the air cleaner element extends into the air cleaner case.

8. The air-intake module for an internal combustion engine as in claim 5, wherein:

the air-intake port extends horizontally outwardly from the wall of the air cleaner case and terminates in an outer end; and the open end of the air cleaner element is attached to the outer end of the air-intake port so that the air cleaner element extends toward an interior of the air cleaner case.

9. The air-intake module for an internal combustion engine as in claim 1, further comprising an air-intake port defining an air inlet to said air cleaner case, said air-intake port extending vertically upwardly from an upper wall of said air cleaner case.

10. An air-intake module for an internal combustion engine, comprising:

an air cleaner including an air cleaner case having an air-intake port defining an air inlet to said air cleaner case;

an air cleaner element mounted to one of said air-intake port and said air cleaner case for cleaning air flowing through said air cleaner case;

a plurality of intake manifold pipes, a first end of each intake manifold pipe being operatively coupled to the air cleaner case for receiving clean air therefrom; and a mounting flange having a mounting surface provided at a second end of each intake manifold pipe for mounting said intake manifold pipes to the engine, wherein:

the air cleaner case, the intake manifold pipes, and the mounting flange are all integrated into a single module, a working line for mounting said single module on the engine is defined in a direction substantially perpendicular to and intersecting said mounting surface of said mounting flange, at least a substantial portion of the air cleaner case is positioned in an area vertically below at least a portion of the manifold pipes so that the manifold pipes extend over the air cleaner case and said working line is defined vertically above the air cleaner case, the air cleaner is disposed in said one of said air cleaner case and said air intake port being disposed substantially immediately adjacent the manifold pipes, and the air cleaner, including said air cleaner case, said air intake port, and said air cleaner element, is disposed within a horizontal length of the manifold pipes.

11. The air-intake module as in claim 10, wherein said first ends of said manifold pipes are connected to a surge tank, a throttle body is connected to said surge tank, and a duct connects the throttle body and the air cleaner case so that clean air from said air cleaner case flows through said duct, said throttle body, and said surge tank into said manifold pipes, and wherein said surge tank, said throttle body and said duct are integrated into said single module.

12. The air-intake module as in claim 10, wherein:

the air cleaner element is generally vertically disposed in the air cleaner case at a side portion of the air cleaner case, the side portion being laterally offset from a vertical plane of the manifold pipes, and wherein said air cleaner element is mounted so as to be removable from said air cleaner case by displacing said air cleaner element generally vertically upwardly, outwardly relative to an upper wall of said air cleaner case.

13. The air-intake module as in claim 10, wherein:

the air cleaner element is generally horizontally disposed in the air cleaner case in an upper portion of the air cleaner case, and said air cleaner element is mounted so as to be removable from said air cleaner case by sliding said air cleaner element generally horizontally, outwardly relative to a wall of said air cleaner case.

14. The air-intake module for an internal combustion engine as in claim 10, wherein:

the air cleaner element has a cylindrical side wall, an open end and a closed end wall; and the air cleaner element is attached to the air-intake port so that a longitudinal axis of the air cleaner element extends in a horizontal direction.

15. The air-intake module as in claim 14, wherein:

the cylindrical side wall of the air cleaner element is undulated whereby the cylindrical side wall is expandable and contractible along said longitudinal axis.

16. The air-intake module as in claim 14, wherein:

the open end of the air cleaner element is attached to the air-intake port so that the air cleaner element extends into an interior of the air cleaner case.

17. The air-intake module as in claim 14, wherein:

the air-intake port extends outwardly from the wall of the air cleaner case and terminates in an outer end; and the open end of the air cleaner element is attached to the outer end of the air-intake port so that the air cleaner element extends toward an interior of the air cleaner case.

18. The air-intake module as in claim 10, wherein said air-intake port extends vertically upwardly from an upper wall of said air cleaner case.

* * * * *